United States Patent [19]

Shlykov et al.

[11] 4,316,314

[45] Feb. 23, 1982

[54] PRESSURE ROLL OF A DRAFTING DEVICE FOR A TEXTILE MACHINE

[76] Inventors: Gennady N. Shlykov, kvartal 19, 31, kv. 3; Vitaly I. Zhestkov, kvartal 19, 26, kv. 41, both of Tashkent, Chilanzar; Valentin N. Tikhonov, ulitsa Sh. Rustaveli, 55, kv. 28, Tashkent; Vasily M. Dyachkov, kvartal 7, 18 "V", kv. 8, Tashkent, Chilanzar; Alexandr K. Kudelin, Teply Stan, 1 mikroraion, korpus 11, kv. 132, Moscow, all of U.S.S.R.

[21] Appl. No.: 70,500

[22] Filed: Aug. 28, 1979

[51] Int. Cl.[3] ..... B21B 31/08; D01H 5/74

[52] U.S. Cl. ..... 29/123; 29/129.5; 19/258

[58] Field of Search ..... 29/123, 113 R, 116 R, 29/129.5, 130; 19/258; 57/58.91

[56] References Cited

U.S. PATENT DOCUMENTS

| | | | |
|---|---|---|---|
| 1,739,939 | 12/1929 | Baehr | 29/129.5 |
| 2,113,836 | 4/1938 | Hamilton | 29/123 U X |
| 2,601,048 | 6/1952 | Monger | 29/123 X |
| 2,862,250 | 12/1958 | Fusaroli | 29/123 X |
| 3,203,073 | 8/1965 | Stein | 29/113 R |
| 3,406,438 | 10/1968 | Reilly | 29/116 R |

FOREIGN PATENT DOCUMENTS

| | | | |
|---|---|---|---|
| 494184 | 3/1930 | Fed. Rep. of Germany . | |
| 646237 | 11/1950 | United Kingdom | 29/123 |
| 945436 | 12/1963 | United Kingdom . | |
| 119816 | 12/1958 | U.S.S.R. | 29/113 R |
| 461180 | 1/1959 | U.S.S.R. . | |

*Primary Examiner*—James Kee Chi

*Attorney, Agent, or Firm*—Fleit & Jacobson

[57] ABSTRACT

A pressure roll of a drafting device comprises a cylindrical casing and a sleeve of an elastic material having flanges. The sleeve is mounted in a spaced relationship to the casing, the flanges of the sleeve are bent toward one another and each flange has two portions of which one portion extends at an angle to the generatrix of the cylindrical casing and the other portion extends in parallel with the generatrix of the cylindrical casing and is secured to the cylindrical casing so that a satisfactory elasticity of the roll along the entire length of its working surface is ensured.

10 Claims, 8 Drawing Figures

PRESSURE ROLL OF A DRAFTING DEVICE FOR A TEXTILE MACHINE

The invention relates to the textile machines manufacture, and more particularly, to a pressure roll of a drafting device to be used in textile machines.

The invention may be most advantageously used in spinning machines.

One of the main functions of a drafting device is to ensure the drafting which, first, makes a product thinner owing to shear of fibers, and second, straighten the fibers and arrange them in a parallel fashion.

The object of the drafting process mainly resides in thinning of a fibrous material.

In a drafting device of any type (cf. USSR Inventor's Certificate No. 461,180) there is an outlet pair of rolls and a feeding pair of rolls. The outlet pair of rolls comprises a lower outlet roll and an upper elastic pressure roll, and the feeding pair of rolls comprises a lower feeding roll and an upper elastic pressure roll, the linear velocity of the outlet pair of rolls being greater than the linear velocity of the feeding pair of rolls by the amount of stretching.

Said elements of drafting devices are designed to develop friction forces between the fibers of the material being handled and between the fibers and the elements of the drafting device.

Friction forces should be such as to ensure the formation of a relatively dense mass of a fibrous material. The density of a fibrous material depends on the amount of load applied at right angle to the direction of flow of a fibrous material being handled.

In providing elements of a drafting device, namely of feeding or outlet pair of rolls, the use should be made of such elastic pressure rolls in which the distribution of friction forces over the cross-section of a fibrous material is uniform.

Pressure rolls, which are generally used for all types of drafting devices, comprise a cylindrical casing journalled in bearings and carrying a sleeve of an elastic material secured to the casing by means of flanges.

One way of improving the output of textile machines resides in an increase in the rate of discharge of a fibrous material being drawn. An increase in the rate of discharge of the fibrous material in the above-described device is associated with difficulties and results in winding of fibers on pressure rolls. This is due to a substantial rigidity of the sleeve because the fiber on the rigid surface of the pressure roll is as if being pressed against it and forced therein, while at high rotary speed of the roll this sticking of the fiber results in a rapid winding of fibers on the rolls thus causing practical inoperability of the outlet pair of rolls. This disadvantage is eliminated when using pressure rolls with an annular space between the sleeve and the cylindrical casing. Fiber cannot be pressed against the elastic yieldable surface of such roll, and fibers slightly sticking to the roll are readily separated therefrom by centrifugal forces. However, since the pressure roll is a generally driven member, another disadvantage of the conventional hollow pressure rolls resides in the provision of rigid portions to ensure a frictional engagement with a driving member, so that the elasticity is non-uniformly distributed lengthwise of the roll.

A roll of this type is known, e.g. from British patent specification No. 945,436 of Dec. 23, 1963. It comprises a cylindrical casing and an elastic sleeve mounted on the casing with annular space therebetween. The sleeve is provided with flanges to hold it axially together with the cylinder. In this pressure roll, the sleeve is made convex with the thickness increasing toward the extremities, and the flanges are located outside the ends of the cylindrical casing.

The disadvantage of this pressure roll resides in that it cannot be used in a high-speed drafting device since the roll exhibits non-uniform rigidity over the cross-section of the material being handled. It should be noted that, owing to the provision of the flanges, the roll rigidity is at maximum at the extremities of the roll at points of its fitting to the cylindrical casing, and the rigidity is at minimum at the middle portion of the roll.

Comparatively uniform distribution of roll rigidity, hence of friction forces over the cross-section of the fibrous material is achieved in another type of a drafting device (cf. German Pat. No. 494,184, Cl.76 c 12/05, 1930), wherein the pressure roll is of an enlarged cross-section in the middle part of the sleeve.

However, this design cannot completely solve the problem of uniform distribution of friction forces over the width of the fibrous material, since there are straight flanges at the points of interconnection of the sleeve and cylindrical casing, which interconnect the sleeve and casing and increase the rigidity at the extremities of the pressure roll, at the points of fastening of the straight flanges to the casing.

It is an object of the invention to provide a pressure roll which ensures substantially uniform distribution of fields of friction forces in a fibrous material being handled due to uniform rigidity of the pressure roll along the generatrix thereof.

Another object of the invention is to provide a pressure roll which ensures uniform distribution of fields of friction forces in a fibrous material along the generatrix of the pressure roll in handling fibrous materials with different cross-sectional shapes.

These and other objects are accomplished by that there is provided a pressure roll of a drafting device, comprising a cylindrical casing supporting a sleeve of an elastic material mounted in a spaced relationship to the casing and secured thereto by flanges to define a closed annular space between the casing and sleeve, the sleeve being internally enlarged in the middle portion thereof, wherein, according to the invention, the flanges of the sleeve are bent toward one another with the formation of at least two portions in each flange of which the first portion extends at an angle to the generatrix of the casing and partially protrudes outside the casing and the second portion extends in parallel with the generatrix between the extremity of the casing and the middle portion thereof and is designed for fastening the elastic sleeve to the casing.

This construction of the pressure roll ensures uniform rigidity thereof in the pinching zone of the pressure roll and cylinder in both feeding and outlet pairs of rolls along the generatrix owing to the fact that the portion of the flange extends at an angle to the roll axis, whereby the rigidity at the extremities of the roll becomes equal to the roll rigidity in the middle portion thereof. A uniform distribution of fields of friction forces in the fibrous material being handled is thereby ensured and the uniformity of discharge of the fibrous material is improved.

The zones of conjugation of the inclined and parallel portions of the flange are preferably made arcuated.

The zones of coupling of the elastic sleeve to the flange are preferably made arcuated.

The radius of arc in the zones of coupling of the inclined portion to the sleeve and the radius of arc in the zones of conjugation of the inclined and parallel portions of the flange are preferably equal to each other.

The thickness of the inclined portion of the flange is preferably from 1:2 to 1:5 to enlarged middle portion of the sleeve.

The inner surface of the sleeve preferably comprises two frustoconical surfaces with their greater bases facing the flanges so that the sleeve is enlarged in the middle portion thereof.

The elastic sleeve of the pressure roll is preferably stepshaped with the thickness increasing to the middle portion.

The elastic sleeve is preferably provided with inner annular projections, the thickness of the projections increasing from the ends toward the middle portion.

The inclined portions protruding from the casing are preferably arcuated.

The invention will now be described with reference to specific embodiments illustrated in the accompanying drawings, in which:

FIG. 1 schematically shows a drafting device;

FIG. 2 schematically shows a pressure roll, in section, with an enlargement in the middle portion of the sleeve with a stepwise increase in thickness;

FIG. 3 schematically shows a sectional view of the pressure roll, wherein the zones of conjugation of the inclined and parallel portions of the flange are arcuated;

FIG. 4 schematically shows a sectional view of the pressure roll, wherein the zones of coupling of the elastic sleeve to the inclined portion of the flange are arcuated;

FIG. 5 schematically shows a sectional view of the pressure roll, wherein the radius of arc in the zones of coupling of the inclined portion to the sleeve and the radius of arc in the zones of conjugation of the inclined and parallel portions of the flange are equal to each other.

FIG. 6 schematically shows a pressure roll, in section with the thickness gradually increasing toward the middle portion;

Before detailed discussion of the pressure roll according to the invention it should be noted that it is designed both for a use in a conventional drafting device, such as that shown and disclosed in USSR Inventor's Certificate No. 364,696, including a feeding pair of rolls and an outlet pair of rolls, each pair comprising a pressure roll, and for separating open-end spinning devices.

Figure 1:
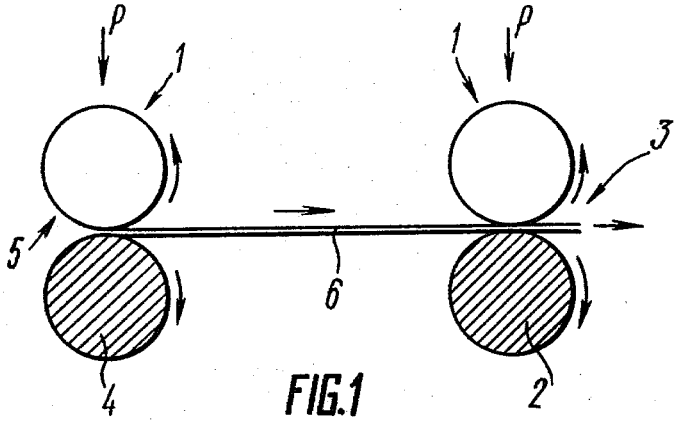

This device is schematically shown in FIG. 1, where pressure rolls according to the invention are shown at 1. One pressure roll is pressed against a lower cylinder 2 of an outlet pair of rolls 3, and the other pressure roll is urged against a lower cylinder 4 of a feeding pair of rolls 5, and a fibrous material 6 is made to pass therebetween.

Figure 2:
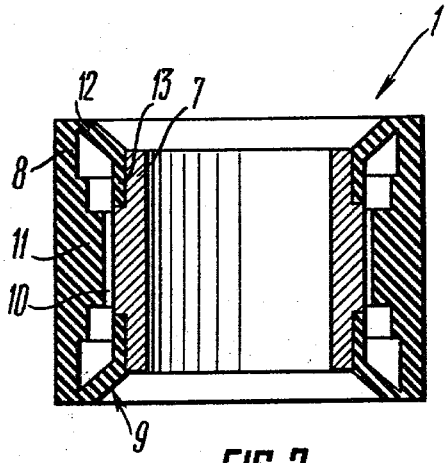

Referring to FIG. 2, where the pressure roll is shown at 1, the pressure roll comprises a cylindrical casing 7 rigidly fixed to a rotary axle (not shown). The casing 7 supports a sleeve 8 made of an elastic material. The sleeve 8 is mounted to the casing by means of flanges 9 and is in a spaced relationship to the casing 7 to define an annular space 10 between the casing 7 and the sleeve 8. The sleeve has inner enlarged portions 11 in the middle portion thereof.

The flanges 9 of the sleeve 8 have two portions of which one portion 12 extends at an angle to the generatrix of the cylindrical casing 7 and the other portion 13 extends in parallel with the generatrix and is designed for fastening to the casing 7.

Figure 3:
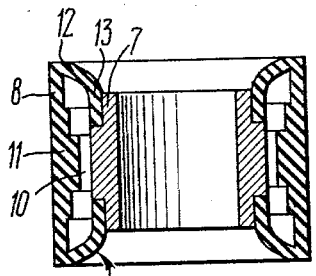
Figure 4:
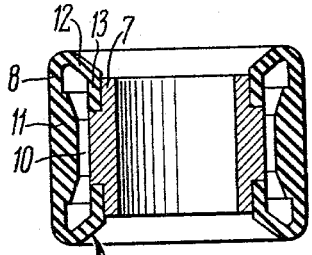
Figure 5:
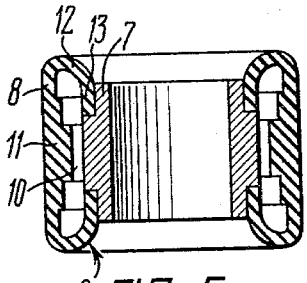

FIGS. 3 through 5 show embodiments of the pressure roll which are basically similar to that described above, and similar elements are indicated at the same reference numerals.

FIG. 3 shows the distinction which resides in that the zones of conjugation of the inclined portion 12 and the parallel portion 13 of the flange 9 are arcuated.

FIG. 4 shows the distinction residing in that the zones of coupling of the elastic sleeve 8 to the inclined portion 12 of the flange 9 are arcuated.

FIG. 5 shows another embodiment, wherein the distinction resides in that the radius of arc in the zones of coupling of the inclined portion 12 to the sleeve 8 and the radius of arc in the zones of conjugation of the inclined portion 12 and parallel portion 13 of the flange 9 are equal to each other.

Figure 6:
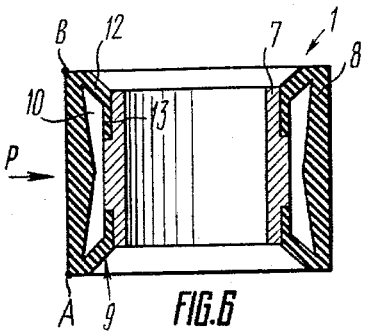

FIG. 6 shows another embodiment of the pressure roll which is mainly similar to those described above, and the same elements are shown at the same reference numerals. The difference resides only in that the inner surface of the sleeve, as can be best seen in the drawing, comprises two truncated cones with their greater bases facing the flanges and their smaller bases facing one another. The thickness of the sleeve thereby increases uniformly from the sleeve ends to the middle thereof.

Figure 7:
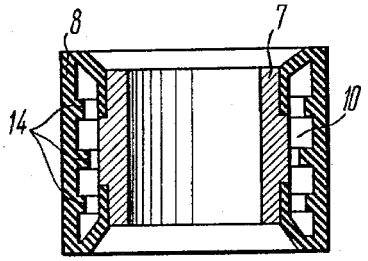
FIG. 7 is another embodiment of the pressure roll according to the invention, wherein the sleeve is provided with annular projections enlarging toward the middle portion of the roll.

FIG. 7 shows still another embodiment of the invention, wherein the sleeve is also mainly similar to that shown in FIG. 2, but the difference resides only in that the enlarged portions internally of the sleeve are provided in the form of annular projections 14 with a height increasing from the ends toward the middle portion of the sleeve.

The pressure roll functions in the following manner.

The fibrous material 6 is made to pass between the feeding pair of rolls and the outlet pair of rolls, the linear velocity of the outlet pair of rolls being greater than the linear velocity of the feeding pair of rolls.

Each pair of rolls has the pressure roll 1 in frictional engagement with a lower cylinder rotated by a drive (not shown).

The pressure roll 1 rotating on an axle presses the fibrous material 6 against the cylinder so that the elastic sleeve bends. The provision of the enlarged portion 11 of the sleeve 8 and flange 9 having one portion 12 extending at an angle to the generatrix of the cylindrical casing ensures uniform pressure of the pressure roll 1 against the cylinder over the entire cross-section of the fibrous material.

To increase the elasticity of the sleeve by reducing the rigidity of the flanges 9, the ratio of the flange thickness to the sleeve thickness at the middle portion thereof may be from 1:2 to 1:5.

The provision in the flanges 9 of two portions 12 and 13 of which one portion extends at an angle to the generatrix of the roll makes it possible to use these portions as a kind of a fulcrum for supporting the sleeve 8 on the cylindrical casing 7 so that upon engagement of the pressure roll 1 with a cylinder 2,4 and application of a load "P," the extreme points "A" and "B" of the sleeve 8 are caused to displace from the middle portion thereof toward the flanges 9 while rotating along an arc about a point which is in the zone of conjugation of the inclined portion 12 and the portion 13 at which the flange is secured to the casing.

As a result of displacement of the points "A" and "B" in the opposite directions, the sleeve 8 is slightly stretched along the generatrix of the roll 1 thereby resulting in a certain increase in the rigidity of the sleeve and equalization of the roll elasticity over the entire length thereof transversely of the flow of the fibrous material.

Figure 8:
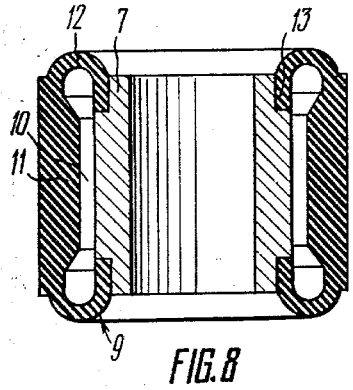
FIG. 8 shows still another embodiment of the roll, wherein the center of the arc in the zones of coupling of the inclined portion of the sleeve coincides with the center of the arc in the zones of conjugation of the inclined and parallel portions.

Finally, further embodiment of the invention is shown in FIG. 8, wherein both the sleeve and the casing are mainly similar at the center to the embodiment shown in FIG. 5, with the only difference being that the center of arc in the zones of coupling of the inclined portion 12 to the sleeve 8 coincides with the center of arc in the zones of conjugation of the inclined portion 12 and parallel portion 13 of the flange.

In all above-described rolls it is preferred that the straight portion of the flange be cemented or otherwise strongly connected to the casing to ensure a tight sealing of the closed space. An elastic medium is the interior of the roll, which is thus formed, functions as a damper for the oscillating working surace of the roll vibrating upon the passage of thicker or thinner portions of the fibrous material. This facility enables the maintenance of uniformly distributed fields of friction forces during the entire operating cycle of the drafting device.

The use of the pressure roll according to the invention enables a substantial improvement in the uniformity of fibrous material designed for high-speed spinning.

While preferred embodiments of the invention have been described above, it will be apparent to those skilled in the art that various modifications and improvements may be made without departure from the spirit and scope of the appended claims.

What is claimed is:

1. In a pressure roll of a drafting device, comprising a cylindrical casing, a sleeve of an elastic material having flanges, which is mounted in a spaced relationship to said casing, said sleeve being secured to said casing by means of said flanges to define a closed space between said casing and said sleeve, the sleeve having an internally enlarged portion in the middle portion thereof, the improvement consisting of that said flanges of said sleeve are bent toward one another and each of said flanges has at least two portions of which the first portion extends at an angle to the generatrix of the cylinder of said cylindrical casing and partially protrudes outside said casing, and the second portion extends in parallel with said generatrix between the extremity of said cylindrical casing and the middle portion thereof and is designed for fastening said elastic sleeve to the cylinder of said cylindrical casing.

2. A pressure roll according to claim 1, characterized in that the zones of conjugation of the first and second portions of the flanges are arcuated.

3. A pressure roll according to claim 1, characterized in that the zones of coupling of the sleeve to the flanges are arcuated.

4. A pressure roll according to claim 1, characterized in that the radius of arc in the zones of coupling of the first portion to the sleeve and the radius of arc in the zones of conjugation of the first and second portions of the flanges are equal to each other.

5. A pressure roll according to claim 1, wherein the thickness of said first portion of said flanges is from 1:2 to 1:5 of the thickness of the enlarged middle portion.

6. A pressure roll according to claim 1, wherein the inner surface of said sleeve comprises two frustoconical surfaces with their greater bases on the side of said flanges so that the thickness of said sleeve increases toward the middle portion thereof.

7. A pressure roll according to claim 1, wherein the inner surface of said sleeve is step-shaped lengthwise.

8. A roll according to claim 1, wherein the second portion secured to the casing is cemented to the casing to ensure a tight sealing of the inner space.

9. In a pressure roll of a drafting device, comprising a cylindrical casing, a sleeve of an elastic material having flanges, which is mounted in a spaced relationship to said casing, said sleeve being secured to said casing by means of said flanges to define a closed space between said casing and said sleeve, the sleeve having an internally enlarged portion in the middle portion thereof, the improvement wherein said sleeve has an outer surface with a material engaging portion disposed intermediate said flanges, and wherein said flanges of said sleeve are bent toward one another and each of said flanges has at least two portions of which the first portion extends at an angle to the generatrix of the cylinder of said cylindrical casing and partially protrudes outside said casing, and the second portion extends in parallel with said generatrix from one of the extremities of said cylindrical casing towards the middle portion thereof, said first flange portion extending between said material engaging portion and said second flange portion so that the flange is bent to position the outer surface of said second flange portion confronting said cylindrical casing so that the outer surface of the flange is secured to the casing.

10. A pressure roll according to claim 9, wherein said cylindrical casing has an inner surface defining a bore extending between the extremities of said casing and an outer surface facing away from said bore, said second portions of said flanges being secured to said outer surface.

* * * * *